US005653351A

United States Patent [19]

Grout et al.

[11] Patent Number: 5,653,351

[45] Date of Patent: Aug. 5, 1997

[54] JET ENGINE BUILD CELL

[75] Inventors: Dennis L. Grout, Oakdale; Francis P. Brochu, Tolland, both of Conn.; James J. Burke, Jr., Feeding Hills, Mass.

[73] Assignee: United Technologies Corporation, Hartford, Conn.

[21] Appl. No.: 569,418

[22] Filed: Dec. 6, 1995

Related U.S. Application Data

[62] Division of Ser. No. 333,400, Nov. 2, 1994, Pat. No. 5,575,607.

[51] Int. Cl.[6] ..... B66C 5/02

[52] U.S. Cl. ..... 212/315; 212/316; 269/900; 414/460

[58] Field of Search ..... 414/461, 460; 269/17, 900; 254/47, 324; 212/315, 316, 314, 324, 344; 248/676

[56] References Cited

U.S. PATENT DOCUMENTS

| | | | |
|---|---|---|---|
| 1,320,740 | 11/1919 | Coghlin | 212/316 X |
| 1,858,183 | 5/1932 | Bridges | 212/315 X |
| 3,341,042 | 9/1967 | Carder | 214/512 |
| 3,606,250 | 9/1971 | Sherman | 254/86 |
| 3,675,786 | 7/1972 | Wilson | 212/316 X |
| 3,715,101 | 2/1973 | Puhringer | 254/87 |
| 3,719,299 | 3/1973 | Oehler | 214/515 |
| 3,783,792 | 1/1974 | Cullom | 212/316 X |
| 3,785,297 | 1/1974 | Barnard | 105/112 |
| 3,918,682 | 11/1975 | Despalmes | 254/87 |
| 4,142,710 | 3/1979 | Okuda | 254/86 |
| 4,236,859 | 12/1980 | Stearn et al. | 414/460 |
| 4,381,839 | 5/1983 | Engler et al. | 212/314 |
| 4,401,408 | 8/1983 | Gibert | 414/687 |
| 4,708,048 | 11/1987 | Brown et al. | 212/314 X |
| 4,771,988 | 9/1988 | Scroggins, Sr. | 254/47 X |
| 4,781,517 | 11/1988 | Pearce et al. | 414/590 |
| 4,995,772 | 2/1991 | Biggio | 414/458 |
| 5,151,004 | 9/1992 | Johnson | 414/495 |
| 5,180,070 | 1/1993 | Feider | 212/324 X |
| 5,219,429 | 6/1993 | Shelton | 254/423 |

OTHER PUBLICATIONS

"Big Bird" *Central Engineering Company*, CENCO, 4 pages, no date.

*Primary Examiner*—Karen B. Merritt
*Assistant Examiner*—Stephen Gordon
*Attorney, Agent, or Firm*—Marina F. Cunningham

[57] ABSTRACT

A system for building, testing, and repairing gas turbine engines and for transporting gas turbine engines from one location to another includes a transporter and a build cell. The build cell is a frame structure supported by a plurality of pedestals for mounting the gas turbine engine thereon and is transportable by the transporter to allow assembly and disassembly of the gas turbine engine at any location. The transporter removes the gas turbine engine from either a build cell or another type of a structure at a first location and transports the gas turbine engine either with or without the build cell to a second location and loads the gas turbine engine onto either a build cell or a second structure.

1 Claim, 6 Drawing Sheets

102
106
100
112
113
122
102
106
111
106
118
110
106
124
126
107
104
108
107
104
108
107
104
108
120

JET ENGINE BUILD CELL

This is a division of application Ser. No. 8/333,400, filed on Nov. 2, 1994, now U.S. Pat. No. 5,575,607.

This invention relates to gas turbine engines and, more particularly, to a system for assembly, disassembly, and transportation of gas turbine engines.

BACKGROUND OF THE INVENTION

Modem demand for faster and more powerful air transportation has resulted in larger and heavier gas turbine engines powering aircraft. Neither the existing manufacturing and repair facilities for gas turbine engines nor the moving vehicles that transport gas turbine engines are equipped to accommodate newer, much larger and heavier gas turbine engines, such as the PW4000 series of engines, manufactured by Pratt & Whitney, division of United Technologies, Hartford, Conn., the assignee of the present invention.

Conventional repair and manufacturing facilities are usually immovable buildings and include numerous support beams mounted on the ceiling of the facility in order to suspend hoists therefore. The hoists are necessary for fabricating and repairing gas turbine engines, since various sections of the gas turbine engine must be suspended and supported by hoists during the gas turbine engine assembly or disassembly. The ceilings of the existing facilities are not strong enough to support the heavier modem engines. To accommodate these newer engines, the roofs of the existing facilities would have to be reinforced to avoid the collapse thereof. Additionally, the floor layout of existing facilities cannot accommodate larger engines. For example, the isles of the existing facilities are only slightly wider than the diameter of the newer engines. It is cost prohibitive and time consuming to re-engineer the existing facilities and to reinforce the ceiling, especially for smaller repair shops.

Furthermore, conventional engine moving vehicles were intended for smaller, conventional gas turbine engines and cannot accommodate the newer gas turbine engines that have increased size and weight. Also, conventional movers are towed and are not easily maneuverable in the narrow isles of existing shops. Additionally, operators of conventional movers must load gas turbine engines from a suspended position onto the mover manually. With heavier and larger engines the task becomes even more labor intensive than with the smaller conventional engines.

Presently, there is no means to service gas turbine engines in close proximity to airplanes. The gas turbine engines must be removed from the airplane and transported into a repair shop for necessary tests and repair. It would be desirable to have the capability to service these engines near the airplane.

DISCLOSURE OF THE INVENTION

According to the present invention, an engine transport vehicle system includes a self-propelled transporter and a build cell with the transporter removing a gas turbine engine from a first structure disposed at a first location, transporting the gas turbine engine from the first location to a second location, and securing the gas turbine engine onto a second structure disposed at the second location. The build cell includes a frame structure supported by a plurality of pedestals for suspending the gas turbine engine and pans of the engine therefrom. The transporter can remove and secure the gas turbine engine onto a supporting structure, whether it is a build cell or other type of a structure with the gas turbine engine suspended therefrom. The transporter can also relocate the build cell with the gas turbine engine secured thereon from a first location to a second location, thereby making disassembly of the gas turbine engine possible at any given location. The transporter can be also utilized to relocate the build cell without the gas turbine engine from one location to another without much effort or time invested.

The transporter includes a frame structure to support the gas turbine engine, a plurality of wheels that support the frame, a drive mechanism to drive the transporter and a plurality of jacks, that lift the transporter from the ground to pick up the suspended engine or the build cell with or without the engine.

One feature of the present invention is that electric motor powering the jacks of the transporter either can be driven by a generator or an extension cable can be plugged into an electrical outlet. Another feature of the present invention is that the transporter can accommodate gas turbine engines of various sizes including smaller and larger engines. A further feature of the present invention is that at least two wheels articulate 90° in each direction, thereby affording the transporter great maneuverability.

One of the primary advantages of the present invention is that the transporter is self-propelled and thus self contained. The transporter does not require an additional engine to tow the mover. This feature affords the transporter additional maneuverability in the narrow isles of a manufacturing or repair facility. A further advantage of the present invention is that the transporter affords great flexibility within the shop. The build cell with the engine can be placed in any location within the shop or outside of the shop, such as nearby the airplane, to repair or test the gas turbine engine. Another advantage of the present invention is that the transporter can be moved in reverse or forward thus affording additional flexibility thereto. Another advantage of the present invention is that the transporter requires only one person to operate it and only two people to remove a gas turbine engine from the wing of the airplane, since the jacks elevate the mover to pick up the engine. Another advantage of the present invention is that the transporter is extremely quiet and does not add undesirable noise to the manufacturing shop.

The foregoing and other objects and advantages of the present invention become more apparent in light of the following detailed description of the exemplary embodiments thereof, as illustrated in the accompanying drawings.

BEST MODE FOR CARRYING OUT THE INVENTION

Figure 1:
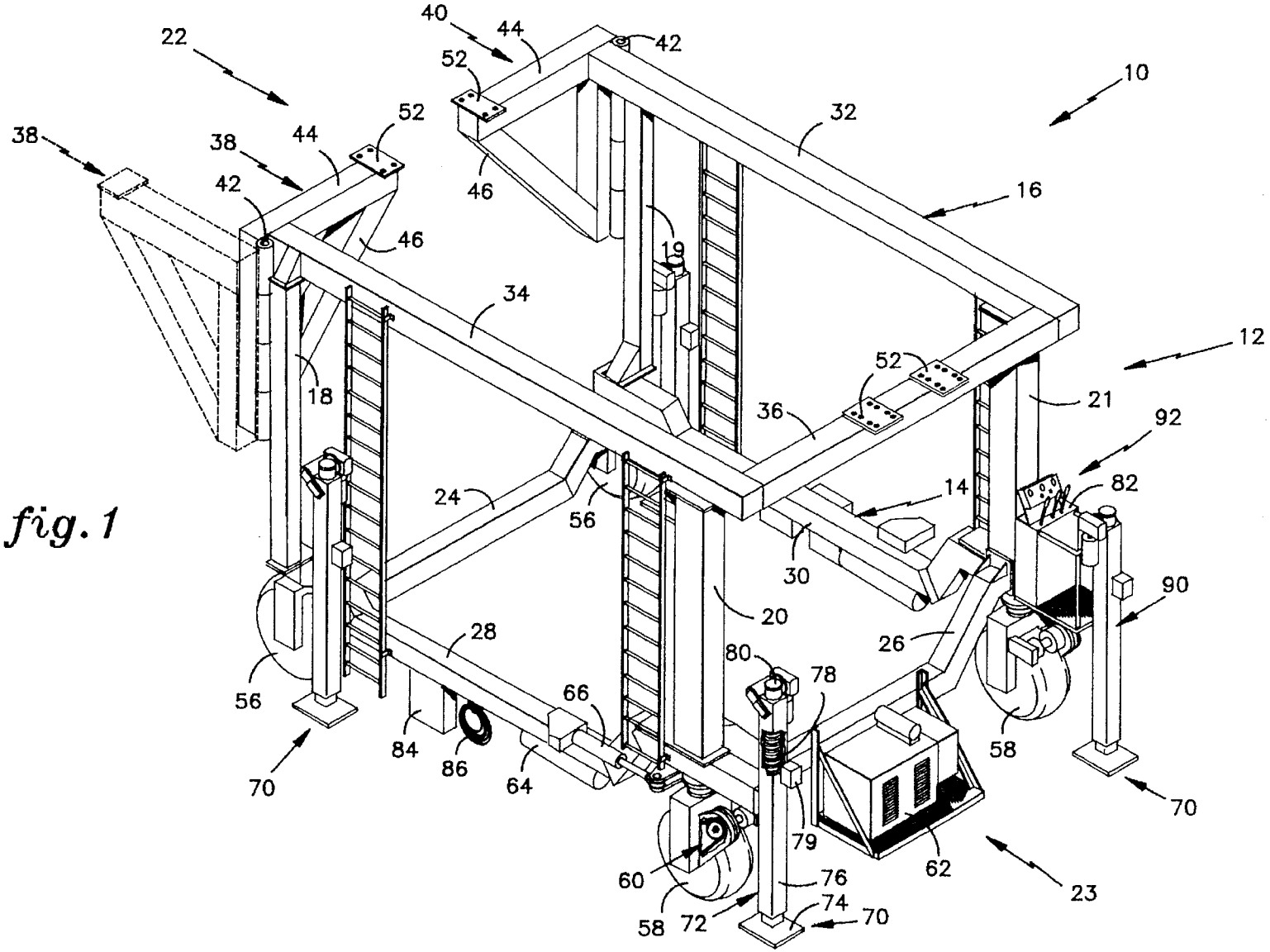
FIG. 1 is a top perspective view of a transporter, according to the present invention.

Referring to FIG. 1, a jet engine transporter 10 includes a frame structure 12 that comprises a lower frame 14 and an upper frame 16 separated from the lower frame 14 and supported by front vertical supports 18, 19 at a front portion 22 of the transporter 10 and rear vertical supports 20, 21 at a rear portion 23 of the transporter 10.

Figure 6:
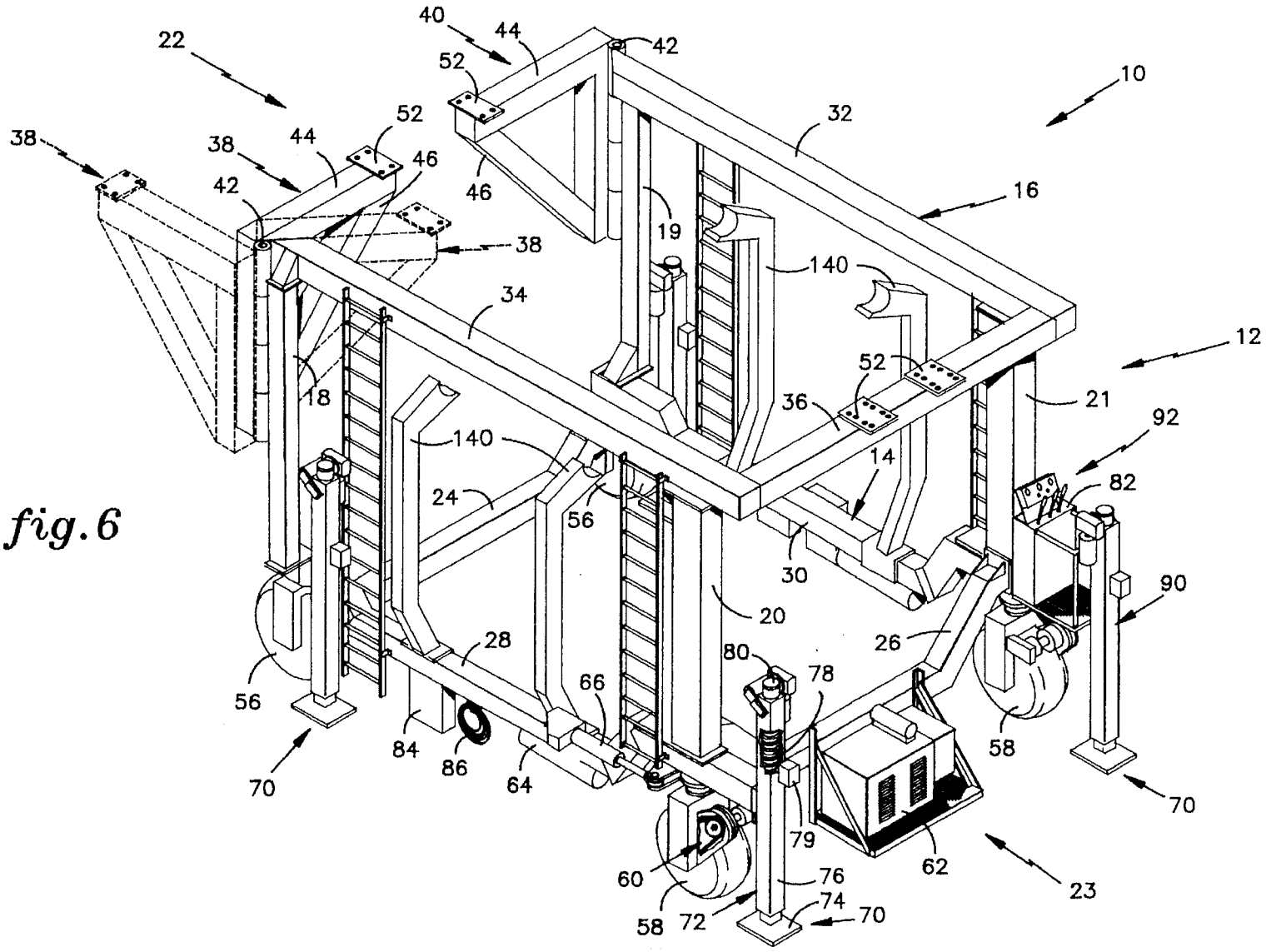
FIG. 6 is a top perspective view of another embodiment of the transporter of FIG. 1.

The lower frame 14 includes a front yoke 24, a rear yoke 26 and lower frame beams 28, 30 connecting the front yoke 24 and the rear yoke 26. The front yoke 24 includes a downward bend to accommodate a larger model of a gas turbine engine to fit therein. The upper frame 16 includes a pair of upper frame beams 32, 34 extending from the front 22 to the rear 23 and attaching to a rear flame cross beam 36 at the rear portion 23 of the transporter. A pair of pivotable arms 38, 40 is hinged on the upper portion of the front vertical supports 18, 19 by means of hinges 42 so that the arms 38, 40 can be moved approximately 135° between an open position and a variety of deployed positions. In the open position, the and 38 is situated in the plane defined by the front vertical support 18 and the rear vertical support 20 and the and 40 is situated in the plane defined by the front vertical support 19 and rear vertical support 21. In one deployed position both arms 38 and 40 are situated in the plane defined by the front vertical supports 18, 19. The arms 38 and 40 can be rotated further inward for other deployed positions; as shown in FIG. 6. Each arm 38, 40 includes a front horizontal cross beam 44, extending substantially horizontally in the plane defined by the upper frame beams 32, 34, and a support member 46 to provide support to the front cross beam 44. When both arms 38, 40 are deployed there is no interference between the front cross beams 44 of arms 38, 40. Pads 52, having multiple bolt holes, are disposed on the rear frame cross beam 36 and on the from cross beams 44. The pads 52 disposed on the front cross beams 44 are movably attached thereto allowing for pivoting about a center point of the pad in the horizontal plane. The frame 12 is fabricated from box beams welded and bolted together.

The frame structure 12 is supported by at least two front wheels 56 and two rear wheels 58. The two front wheels 56 are non-driven and are not steered. The two rear wheels 58 are driven by sprocket and chain 60 disposed above each rear wheel 58. The sprocket and chain 60 are driven by an engine 62 attached to the rear yoke 26. The engine 62 is powered by propane, delivered to the engine 62 from a propane tank 64 attached to the lower frame beam 28. The rear wheels 58 include hydraulic steering, with the engine 62 driving a hydraulic pump (not shown) to provide hydraulic pressure to drive a hydraulic cylinder 66, which actuates the rear wheels 58 through a linkage and a wheel yoke (not shown). The rear wheels 58 turn 90° in each direction to provide maneuverability to the transporter 10.

At least four jacks 70 are fixedly attached to the lower frame 14, so that an equal number of jacks is provided on each side of the transporter 10 and are generally disposed across from each other to provide the most stability. Each jack 70 includes a jack body 72 and a foot 74 movably attached to the bottom of the jack body 72. The jack body 72 comprises a jack cover 76, a jack screw 78 inside the cover 76, a sensor 79, and a motor 80 disposed on top of the jack 70. Each jack 70 is wired to a jack control box 82 and to the motor 80 that rams a screw driven box jack. A generator 84, driven by the engine 62, supplies power to the electric motor 80. Alternatively, the electric motors 80 can obtain power from an external electrical source through a cable 86. The sensors 79 monitor relative positions of jacks 70 to synchronize the movement of all the jacks. The jacks 70 can be also manually activated in case of emergency or power failure. The jacks 70 elevate the transporter 10 off the ground to a maximum height of 26 inches between the bottom of the wheels 56, 58 and the ground. The movable foot 74 allows jacks 70 to compensate for uneven ground underneath.

A driver's cabin 90 is disposed at the rear portion 23 of the transporter 10 with the steering and driving controls 92 within the reach for a driver to drive and steer the transporter 10.

Figure 2:
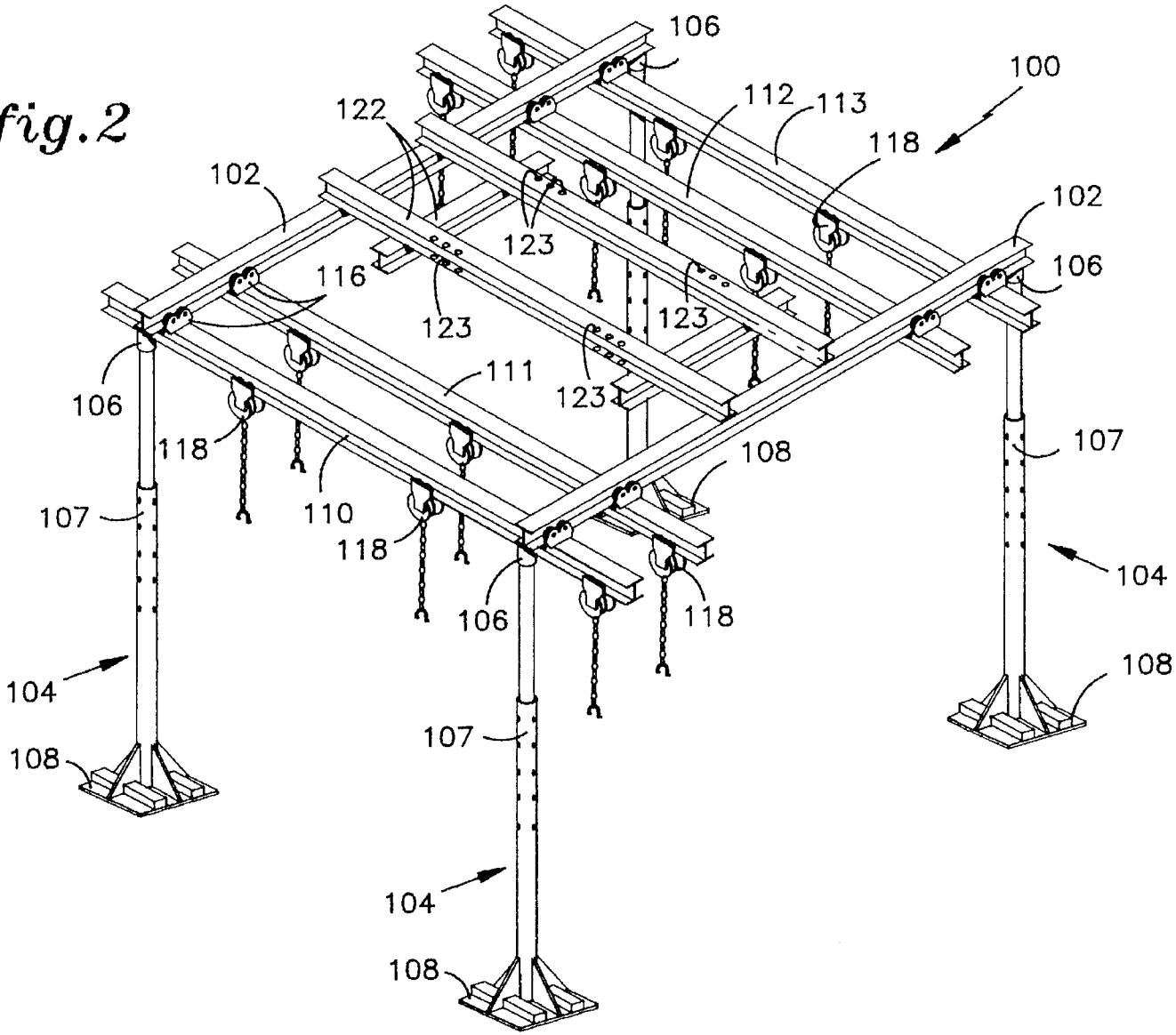
FIG. 2 is a top perspective view of a build cell supported by four pedestals, according to the present invention.

Referring to FIG. 2, a build cell 100 comprises two cross beams 102 spaced apart from each other and resting on adjustable pedestals 104. Each cross beam 102 includes a pair of cups 106, welded onto each end thereof, that fit over the top ends of the pedestals 104. Each pedestal 104 has a telescoping body 107, the height of which is adjustable, and a base 108. The build cell 100 also includes transversing hoist beams 110–113 that transverse the cross beams 102 in a substantially perpendicular relationship thereto by means of trolleys 116. A plurality of hoists 118 is movably suspended from the hoist beams 110–113 to support parts of a disassembled gas turbine engine 120. The hoist beams 110–113 overhang past each cross beam 102 on both sides of the cross beams 102 to allow additional travel space for the hoists 118.

Figure 3:
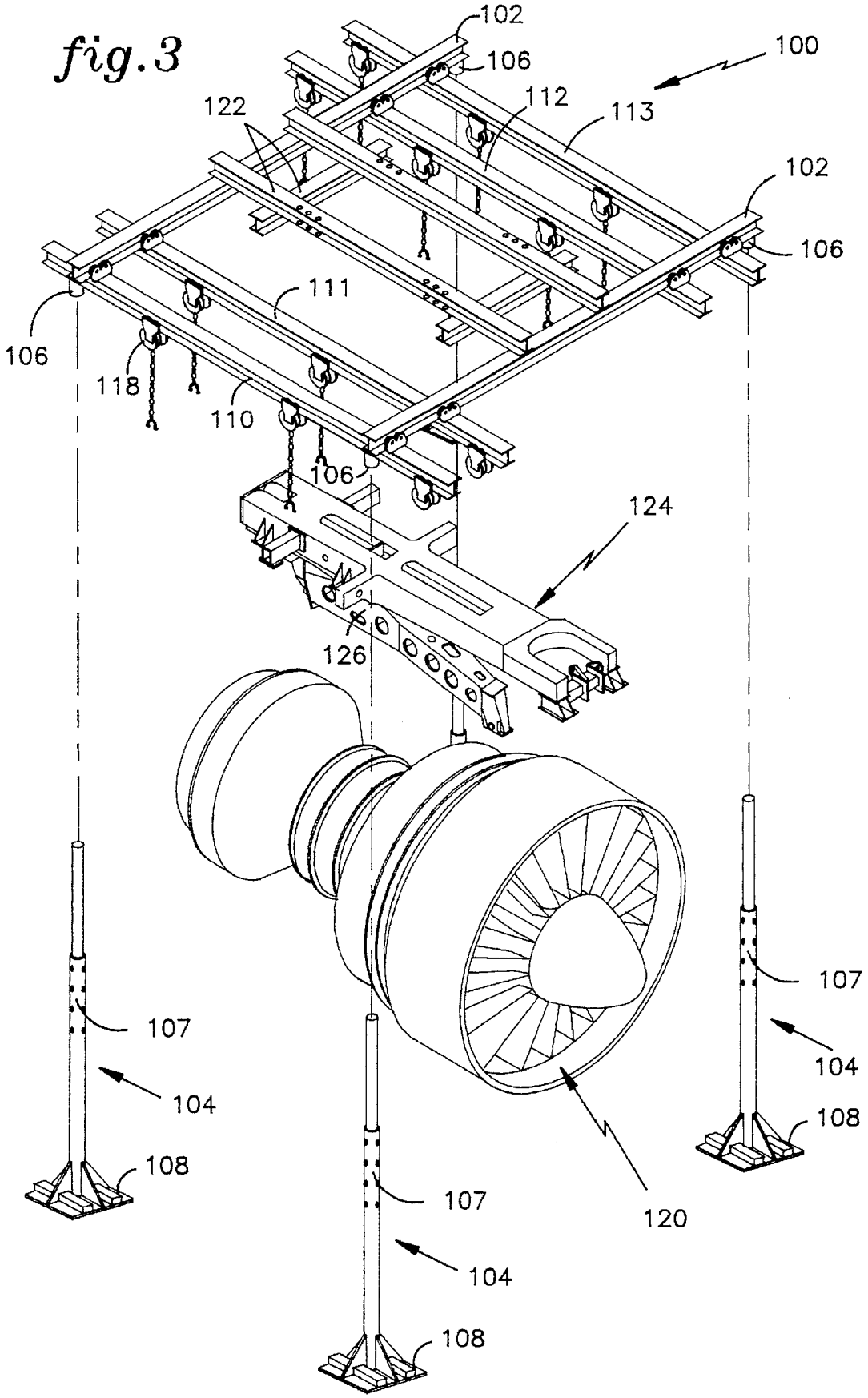
FIG. 3 is an exploded, top perspective view of a gas turbine engine mounted on a build cell of FIG. 2.

A support structure 122, having multiple bolt holes 123 corresponding to various lengths of gas turbine engines, is mounted onto the cross beams 102 at the medial portion thereof for suspension of the gas turbine engine 120 therefrom. Referring to FIG. 3, an intermediate adapter 124 is bolted onto the support structure 122 and is adapted to accommodate a pylon 126 bolted thereon with the gas turbine engine 120 suspended therefrom. The cross beams 102 and the transversing hoist beams 110–113 are steel I-beams.

Figure 4:
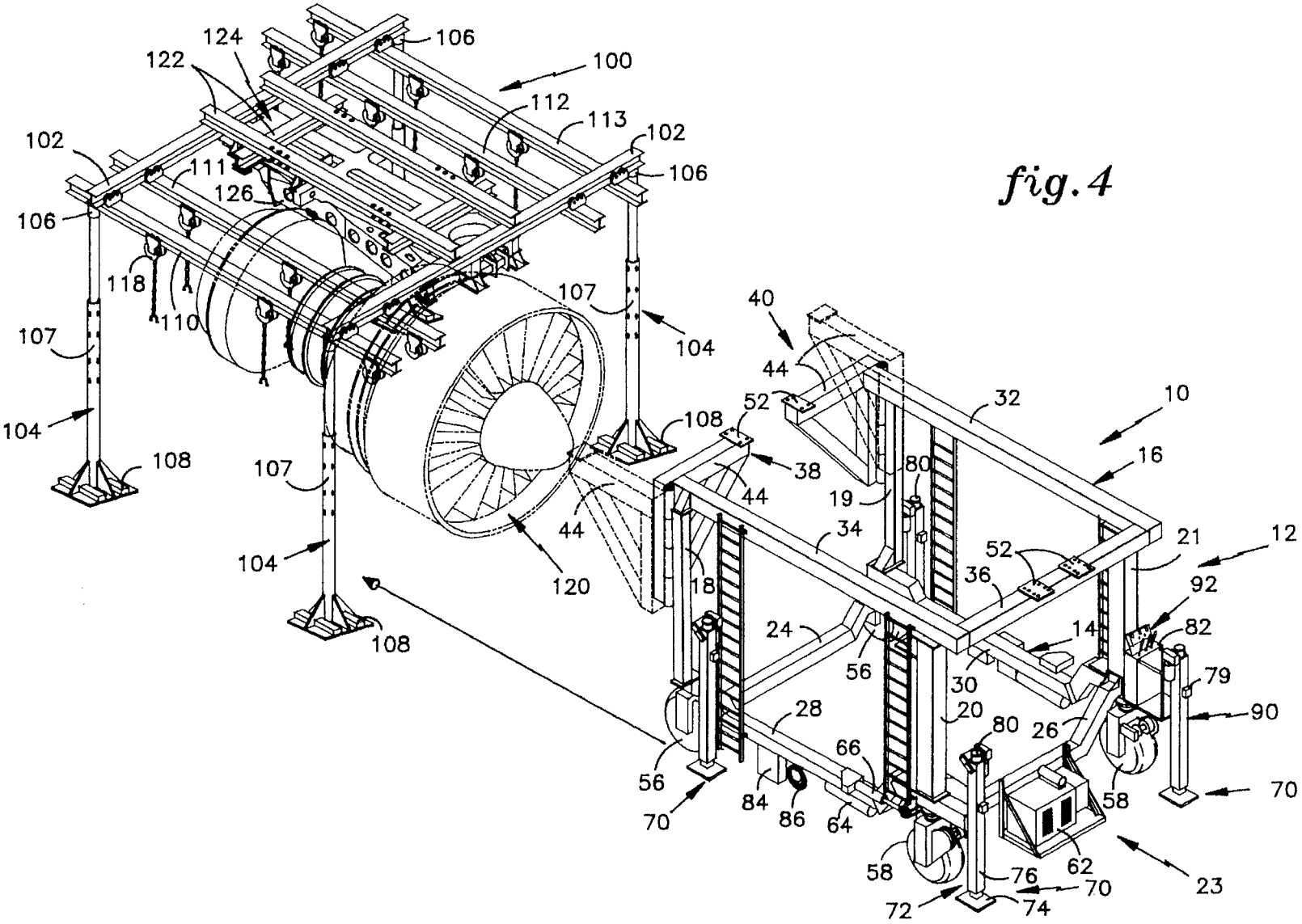
FIG. 4 is a top perspective view of the transporter of FIG. 1 having pivotable arms in an open position and being driven into the build cell of FIG. 2.
Figure 5:
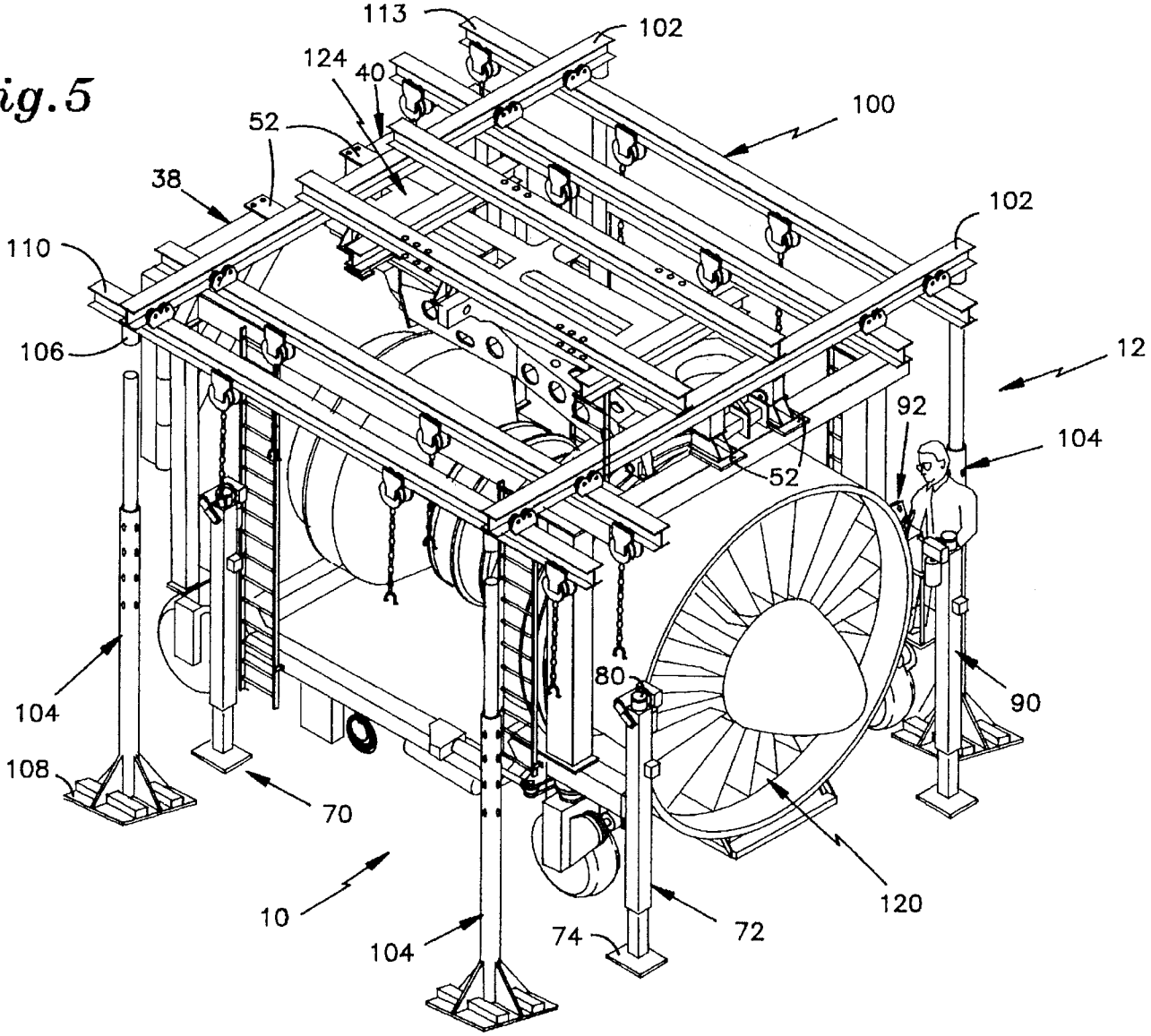
FIG. 5 is a perspective view of the transporter of FIG. 1 positioned underneath the build cell of FIG. 2 having a gas turbine engine secured thereon with the transporter lifting the build cell and the gas turbine engine off the ground.

One mode of operation for the transporter 10 is to transport the build cell 100 with the gas turbine engine 120 mounted thereon from one location to another. The transporter 10 is driven underneath the build cell 100 supported by the pedestals 104, as shown in FIG. 4. The front portion 22 of the transporter 10 enters underneath the gas turbine engine 120 first with the pivotable arms 38, 40 in the open position so that the rear frame cross beam 36 and the engine 62 disposed at the rear portion 23 of the transporter do not interfere with the gas turbine engine 120. Once the transporter 10 is positioned underneath the gas turbine engine 120, the pivotable arms 38, 40 are rotated at least 90° but not more than 135°, into the deployed position and locked in that position. The transporter 10 is visually aligned underneath the build cell 100. The jacks 70 are activated to lift the transporter 10 off the ground. The movement of the jacks 70 is controlled through the jack control box 82. The transporter is elevated so that the upper frame beams 32, 34 of the transporter make contact with the cross beams 102 of the build cell 100. The cross beams 102 of the build cell 100 rest on the upper frame beams 32, 34 and subsequently are bolted thereon. The transporter is further elevated until the cups 106 of the build cell 100 clear the tops of the pedestals 104, as shown in FIG. 5. The pedestals 104 are then removed by a forklift and placed at a new location. Subsequently, the jacks 70 are activated to lower the transporter 10 onto the ground and the transporter 10 with the build cell 100 and the gas turbine engine 120 is driven to the new location. At the new location, the jacks are activated to elevate the transporter off the ground so that the cups 106 of the build cell are disposed higher than the pedestals 104. The pedestals 104 are then placed underneath the build cell 100. Jacks 70 are activated to lower the transporter 10 with the build cell 100 and the gas turbine engine 120 to place the cups 106 of the build cell 100 over the tops of the pedestals 104. Once the build cell 100 is supported by the pedestals 104, the build cell 100 is unbolted from the transporter and the jacks 70 are further activated to lower the transporter 10 to the ground. Once the transporter 10 reaches the ground, the transporter 10 is driven away.

The transporter 10 can be used in analogous manner to transport the build cell 100 without the gas turbine engine 120 attached thereto.

Another mode of operation for the transporter 10 is to transport gas turbine engines 120 without the build cell 100. The above described embodiment of the transporter 10 can also transport the gas turbine engine 120 with the intermediate adapter 124 and the pylon 126 attached thereto. The transporter 10 is driven underneath the build cell 100 with the gas turbine engine 120 secured thereon. The front portion 22 of the transporter 10 enters underneath the gas turbine engine 120 first with the pivotable arms 38, 40 in the open position so that the rear frame cross beam 36 and the engine 62 disposed at the rear portion 23 of the transporter do not interfere with the gas turbine engine 120. The transporter 10 is visually aligned underneath the gas turbine engine 120 with the help of alignment rods that are attached on the transporter 10 and on the build cell. Subsequently, the pivotable arms 38, 40 are rotated at least 90° into the deployed position and locked in that position. Thereafter, the jacks 70 are activated to lift the transporter off the ground toward the build cell 100. The transporter is elevated until the rear frame cross beam 36 and the front horizontal cross beams 44 come in contact with the lower surface of the intermediate adapter 124. Once the intermediate adapter 124 rests on the upper frame 16 of the transporter, the intermediate adapter 124 is bolted onto the pads 52 of the rear frame cross beam 36 and front cross beams 44. For smaller gas turbine engines having shorter intermediate adapters, the arms 38, 40 can be rotated additionally to compensate for the shorter intermediate adapters. The pads 52 disposed on the front horizontal cross beams 44 can be pivoted to achieve proper alignment with the intermediate adapter 124. The intermediate adapter 124 is then unbolted from the support structure 122 of the build cell 100. Subsequently, jacks 70 are activated to lower the transporter to the ground. The transporter 10 then transports the gas turbine engine 120 to a new location. At the new location, the transporter 10 is visually aligned underneath another build cell 100 supported by the pedestals 104. The jacks 70 are activated to elevate the transporter until the intermediate adapter 124 comes into contact with the build cell 100. Once the contact between the build cell 100 and the intermediate adapter 124 is established, the intermediate adapter 124 is bolted onto the support structure 122 of the build cell 100 and unbolted from the pads 52 of the transporter 10. The bolt holes in the intermediate adapter 124 are oversized to allow for visual misalignment. The jacks 70 are activated to lower the transporter 10 onto the ground with the jacks resuming the original position. The pivotable arms 38, 40 are rotated into the open position and the transporter is driven away from the gas turbine engine 120 in the rearward direction thereof.

FIG. 6 depicts another embodiment of the transporter. The transporter includes a plurality of hydraulic claws 140. It is well known in the art that gas turbine engines include a plurality of mounting handles disposed thereon. The claws are adapted to attach onto these mounting handles disposed on the gas turbine engine. The claws 140 include an open position and a deployed position. This embodiment of the transporter is capable of picking up a gas turbine engine from the wing of an airplane or similar structure. The transporter 10 is driven underneath the gas turbine engine suspended from the wing of an airplane with the claws 140 in the open position to receive the gas turbine engine within the frame 12. The jacks 70 are then activated to elevate the transporter. Subsequently, the claws 140 are activated into the deployed position to attach onto the mounting handles of the gas turbine engine. The engine is then unbolted from the wing of the airplane. Once the gas turbine engine is supported by the transporter, the transporter is lowered onto the ground and driven away.

One of the major advantages of the transporter of the present invention is the maneuverability. More than one feature of the transporter contributes to its exceptional maneuverability. First, the transporter is self-propelled and self-contained, therefore not requiring a towing engine. This allows maneuverability in narrow isles of existing shops. Second, the rear wheels 58 include 180° total articulation that permits the transporter to turn around without requiring much space. Additionally, the transporter moves in either direction, forward or rearward.

Another great advantage of the transporter is the flexibility it affords in the shop. The transporter can relocate either a build cell with a gas turbine engine, a build cell alone, or a gas turbine engine alone within the shop. Additionally, the transporter can transport same combinations of the build cell and gas turbine engines outside the shop as well, making possible to repair a gas turbine engine near an airplane. Furthermore, the second embodiment of the transporter allows removal of a gas turbine engine off of the airplane wing. The transporter is extremely efficient and does not require labor intensive operations. The transportation of either build cell with a gas turbine engine, a build cell alone or gas turbine engine alone requires only one driver. The lifting action of the jacks 70 allows the transporter to pick up the engine off the build cell without requiring labor intensive operations. Only two operators are needed to remove a gas turbine engine from a build cell or the airplane wing. Furthermore, any operation can be performed within minutes, thereby resulting in time and cost savings.

The transporter accommodates gas turbine engines of all sizes including the newer, larger and heavier engines, such as PW4000 series, manufactured by Pratt & Whitney. The arms 38, 40 and pivoting pads 52 disposed on the front cross beams 44 of the arms 38, 40 are provided to accommodate smaller gas turbine engines with shorter intermediate adapters 124.

The availability and simple relocation of the build cell with or without the gas turbine engine affords flexibility and allows improved utilization of a shop floor. The build cell can be used for building, testing, or repairing of gas turbine engines. The build cell can be placed at any location inside or outside of a shop. The relocation of the build cell can be facilitated within minutes without a labor intensive operation. The build cell also eliminates the need to reinforce the ceilings of existing manufacturing and repair shops that cannot handle the weight of newer and heavier engines. One size of the build cell can accommodate engines of various sizes. The multiple bolt holes 123 in the support structure are provided to accept intermediate adapters for use with of a different length and size engines.

Additionally, the transporter is very quiet, thereby not adding undesirable noise to the shop.

Although the invention has been shown and described with respect to exemplary embodiments thereof, it should be understood by those skilled in the art that various changes, omissions, and additions may be made thereto, without departing from the spirit and scope of the invention.

We claim:

1. A build cell for supporting a gas turbine engine during building, testing or repairing thereof, said build cell characterized by:

a frame structure for suspending said gas turbine engine and a plurality of hoists suspended therefrom;

said frame structure being supported by a plurality of pedestals, each pedestal having a telescoping body and a base, said telescoping body being adjustable in height, said base being disposed on the bottom of said telescoping body to support each said pedestal; and said frame structure on the ground, said frame structure being removable from said pedestals; and said frame structure having two cross beams spaced apart and a plurality of translating beams movably suspended from said cross beams in a substantially perpendicular relationship thereto to translate along said cross beams, each said cross beam includes a cup on each end thereof to receive said pedestals therein, said translating beams having a number of said plurality of hoists movably secured thereon, a support structure being mounted onto said frame structure to accommodate said gas turbine engine thereon.

* * * * *